United States Patent [19]

Nishio et al.

[11] 4,224,554

[45] Sep. 23, 1980

[54] SPARK PLUG HAVING A LOW NOISE LEVEL

[75] Inventors: Kanemitsu Nishio, Komaki; Shunichi Takagi, Tajimi; Mitsutaka Yoshida, Chita, all of Japan

[73] Assignee: NGK Spark Plug Co., Ltd., Nagoya, Japan

[21] Appl. No.: 38,772

[22] Filed: May 14, 1979

[30] Foreign Application Priority Data

May 20, 1978 [JP] Japan ..... 53-60447
Nov. 24, 1978 [JP] Japan ..... 53-145691

[51] Int. Cl.[2] ..... H01T 13/40
[52] U.S. Cl. ..... 315/53; 315/62
[58] Field of Search ..... 315/53, 62

[56] References Cited

U.S. PATENT DOCUMENTS

| | | | |
|---|---|---|---|
| 1,968,225 | 7/1934 | Shell et al. | 315/62 |
| 1,984,526 | 12/1934 | Given | 315/53 |
| 3,882,341 | 5/1975 | Green | 315/62 X |
| 3,883,776 | 5/1975 | Berry | 315/62 X |
| 4,029,990 | 6/1977 | Nagy et al. | 315/62 |

*Primary Examiner*—Alfred E. Smith
*Assistant Examiner*—Charles F. Roberts
*Attorney, Agent, or Firm*—Stevens, Davis, Miller & Mosher

[57] ABSTRACT

A spark plug incorporating a winding type inductor has a low noise level from a low frequency range to a high frequency range. The spark plug comprises a ceramic insulator having a bore, a metal fitting surrounding the insulator, a center electrode, a terminal electrode and a noise-attenuation element arranged in the bore of the ceramic insulator and sealed to the center and terminal electrodes through glass, said noise-attenuation element consisting of an inductance component alone or a combination of an inductance component and a resistance component, and said inductance component being arranged extending to both sides of a sealed level for the noise-attenuation element formed by an end of the metal fitting which is connected to the insulator.

4 Claims, 13 Drawing Figures

SPARK PLUG HAVING A LOW NOISE LEVEL

BACKGROUND OF THE INVENTION

1. Field of the Invention

The present invention relates to a spark plug having a low noise level, and more particularly relates to a spark plug incorporating a winding type inductor and having a high noise-attenuation effect over a wide frequency range.

2. Description of the Prior Art

Recently, noise and electric wave disturbance have been legally restricted in Canada and other countries and are going to be legally restricted in many countries. In order to satisfy these demands, a shield type plug cap incorporating a winding type inductor is mainly used as a spark plug for internal combustion engines, such as a snow mobile, outboard engine and the like.

However, the shield-type plug cap has such drawbacks that voltage drop due to a large electrostatic capacity occurs, and particularly leakage of electric current occurs under a high-moisture environment, such as rainfall.

SUMMARY OF THE INVENTION

An object of the present invention is, therefore, to provide a spark plug incorporating a winding type inductor and having a noise-preventing property, which is at least equal to that attained by the above described shield cap.

A feature of the present invention is to provide a spark plug having a low noise level comprising a ceramic insulator having a bore, a metal fitting surrounding the insulator, a center electrode, a terminal electrode and a noise-attenuation element arranged in the bore of the insulator and sealed to the center and terminal electrodes through glass, an improvement comprising said noise-attenuation element consisting of an inductance component alone or a combination of an inductance component with a resistance component, and said inductance component being arranged extending to both sides of a sealed level for the noise-attenuation element formed by an end of the metal fitting which is connected to the insulator.

Further objects and features of the present invention will be understood from the following detailed description with reference to the accompanying drawings.

DETAILED DESCRIPTION OF THE INVENTION

A spark plug generally comprises a center electrode insulated by a ceramic insulator and a metal fitting surrounding the ceramic insulator, and is secured to a cylinder head through the metal fitting. Therefore, when a winding type inductor is inserted into a bore of the ceramic insulator, a shielding effect by the metal fitting can be easily obtained. In addition, there is no risk of electrostatic capacity being enlarged nor electric current being leaked as in the case of the shield cap. The excellent noise-preventing effect by the shield cap depends only upon the shield, and therefore, in order to obtain a noise-preventing effect equal or superior to the effect attained by the shield cap, it is important to construct a spark plug so that the winding type inductor incorporated therein is sufficiently shielded.

The inventors have investigated the influence of the position of an inductor or a resistor inserted in the bore of the ceramic insulator upon the noise-preventing effect, and found out the following surprising behavior, which will be explained hereinafter referring to FIGS. 1 and 2.

Figure 1:
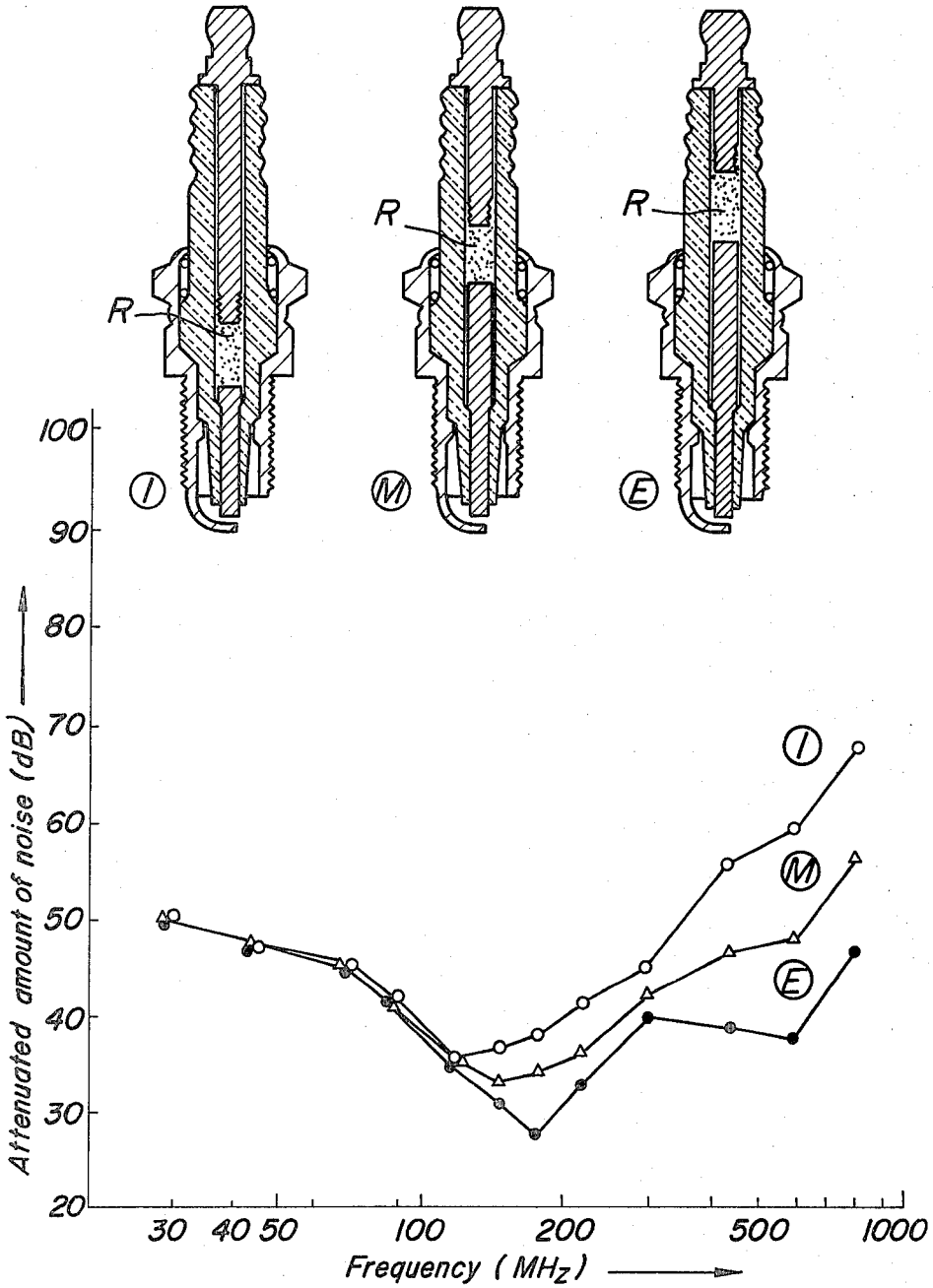
FIG. 1 is a graph showing a relation between the frequency and the attenuated amount of noise corresponding to the position of a resistor inserted into the bore of a ceramic insulator.

FIG. 1 shows an influence of the position of a resistor R in the bore of a ceramic insulator upon the attenuated amount of noise, when the resistor R having a certain length was inserted into the bore and the lengths of the central and terminal electrodes were varied so that the resistor will be positioned extending to the internal side, external side or both sides of the sealed level formed by the caulking edge of the metal fitting, and the attenuated amount of noise was measured in the wide frequency range of 30–800 MHz according to the V.D.E. (Verband Deutscher Electrotechniker) Standard in Germany.

Figure 2:
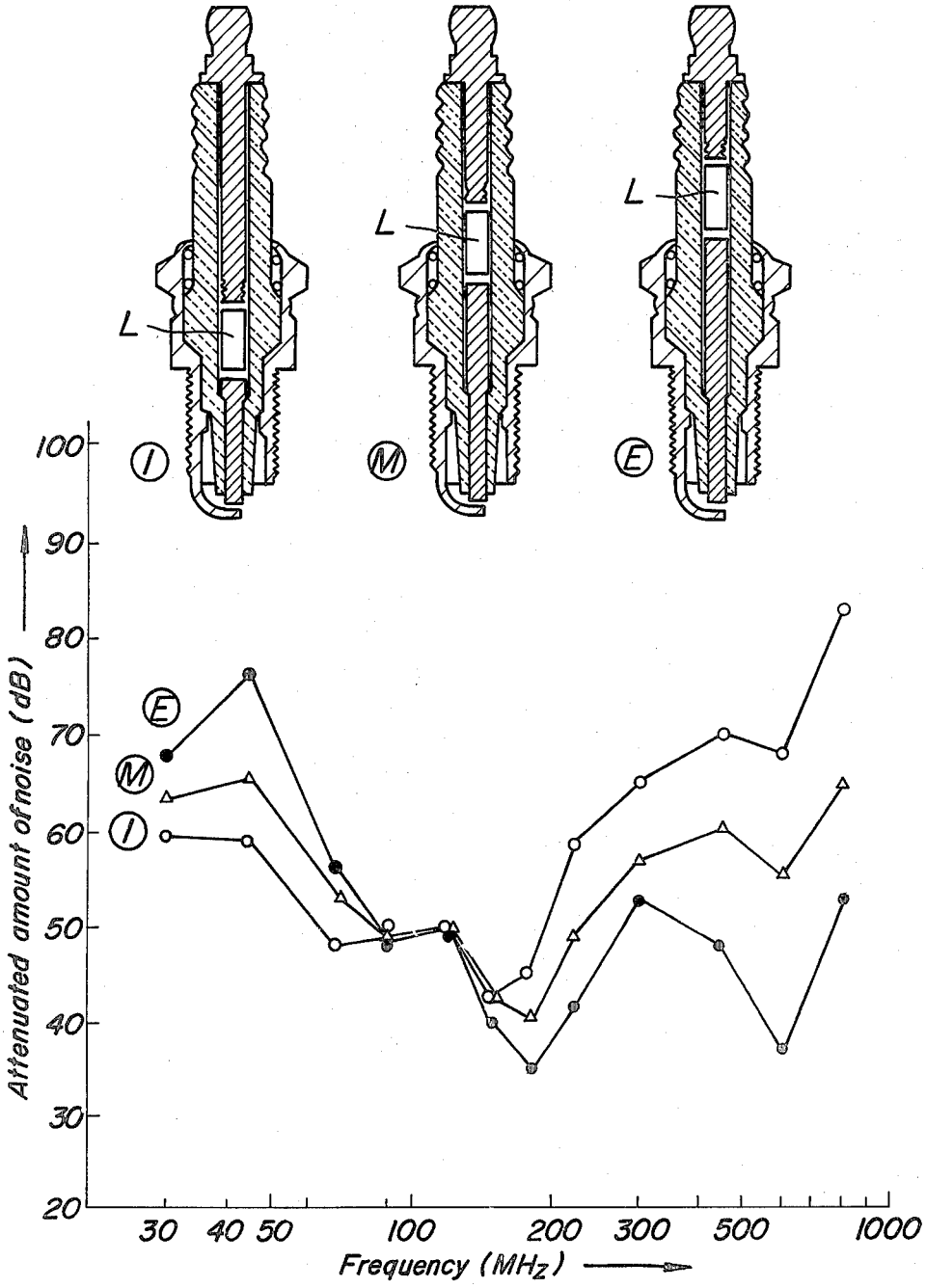
FIG. 2 is a graph showing a relation between the frequency and the attenuated amount of noise corresponding to the position of an inductor inserted into the ceramic insulator.

FIG. 2 shows an influence of the position of the inductor L inserted into the bore of a ceramic insulator upon the attenuated amount of noise measured in the same manner as described in the measurement of FIG. 1.

In FIGS. 1 and 2, the attenuated amount of noise in the internal arrangement I, intermediate arrangement M or external arrangement E of the resistor R or inductor L based on the sealing level by the metal fitting is shown by white circles, white triangles or black circles, respectively.

It can be seen from FIG. 1 that, in the spark plug incorporating a resistor, there is substantially no difference in the noise-attenuation property between the internal arrangement I, intermediate arrangement M and external arrangement E in the low frequency range. However, in the high frequency range, the internal arrangement I is superior to other arrangements. Accordingly, the internal arrangement I exhibits an excellent noise-attenuation property over the whole frequency range.

While, according to FIG. 2, when an inductor L is inserted into the bore of the ceramic insulator, the arrangement of the inductor has a high influence upon the noise-attenuation property of the spark plug, and the external arrangement E, which exhibits an excellent noise-attenuation property in the low frequency range, has a poor noise-attenuation property in the high frequency range. On the contrary, the internal arrangement I has an excellent attenuation property in the high frequency range, but has a poor noise-attenuation property in the low frequency range. The intermediate arrangement M exhibits an excellent noise-attenuation property in both the high and low frequency ranges.

It can be seen from the above obtained results that the position of the inductor in the bore of the ceramic insulator is important to attain an excellent noise-preventing effect over a wide frequency range of 20–1,000 MHz legally restricted in Canada. This discovery, that is, the fact that the position of the inductor in the bore has a high influence upon the frequency range, wherein noise is effectively attenuated, is very important in the design of a spark plug incorporating a winding type inductor.

Figure 3:
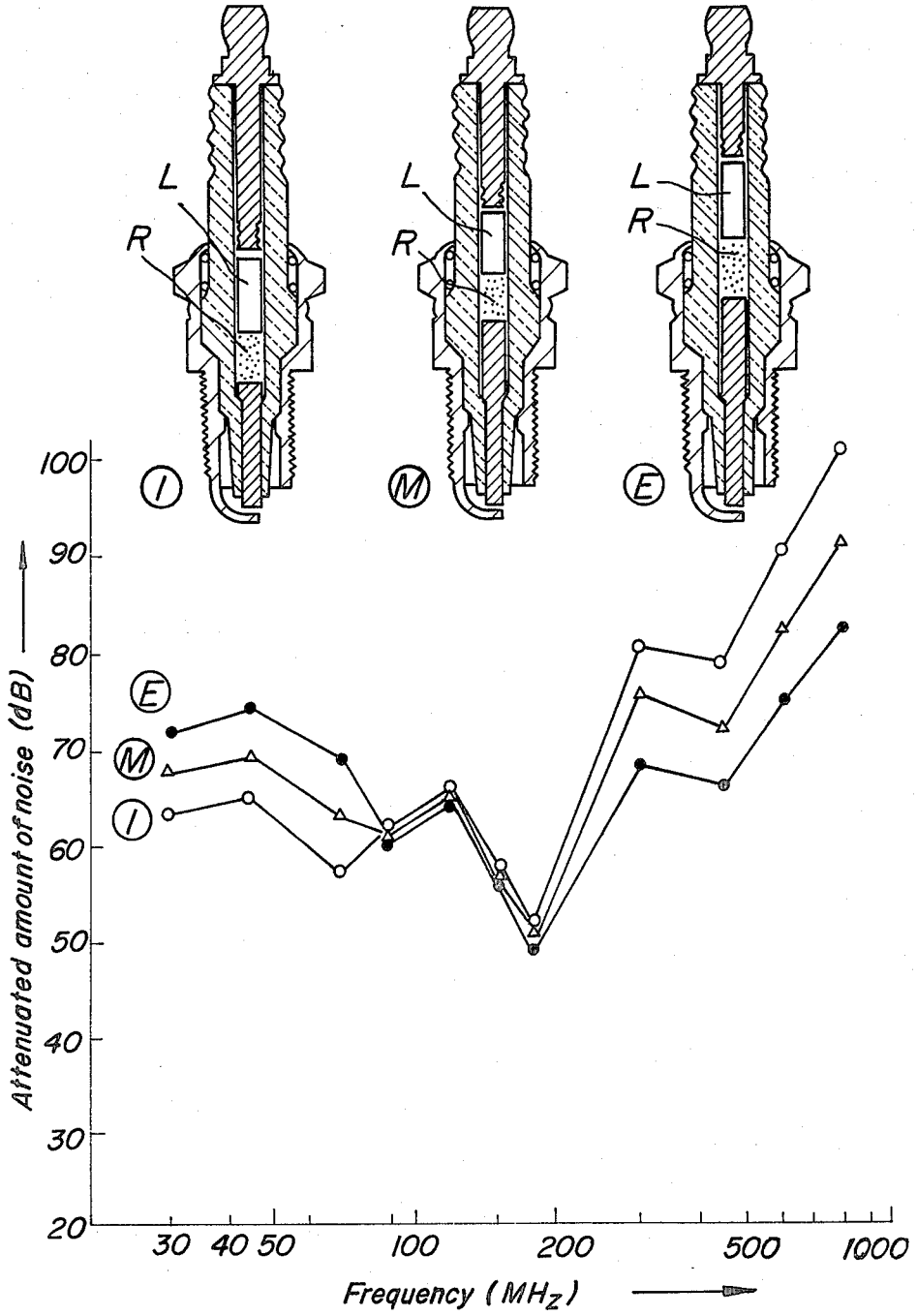
FIGS. 3 and 4 are same graphs as those of FIGS. 1 and 2, when both of an inductor and a resistor or a cartridge type inductor containing a resistance component are inserted into the bore.
Figure 4:
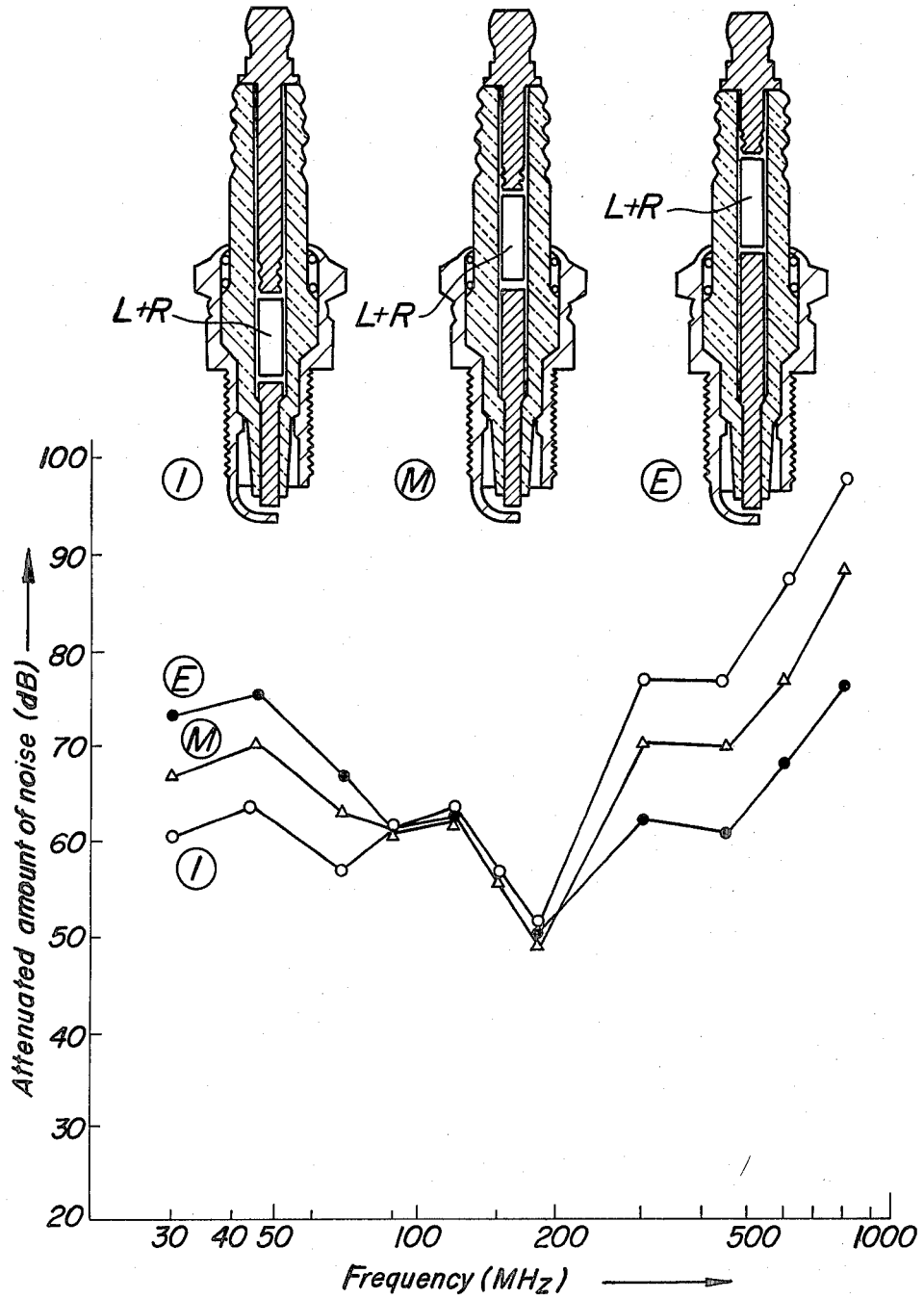

The inventors have made further investigations with respect to a noise-attenuation element consisting of a combination of an inductor and a resistor, or consisting of an inductor containing a resistance component. In the experiments, the position of the resistor or inductor of the combination system in the bore, and the position of the inductor containing a resistance component in the bore were classified into the internal arrangement I, intermediate arrangement M and external arrangement E, and the noise-attenuation property of the inductor in combination with the resistor and that of the inductor containing a resistance component in these arrangements were examined in the frequency range of 30–800 MHz. FIGS. 3 and 4 show the results. In FIGS. 3 and 4, the attenuated amount of noise in the internal arrangement I, intermediate arrangement M or external arrangement E of the inductor L in combination with the resistor R or of the inductor containing a resistance component (L+R) is shown by white circles, white triangles or black circles, respectively.

When the resistor is arranged in the internal side of the sealed level and the inductor is arranged in the internal side, in the external side or in both sides of the sealed level as shown in FIG. 3, although the noise-attenuation effect by the internal arrangement of the resistor appears in the high frequency range, a noise-attenuation effect by the arrangement of the inductor appears more predominantly, and hence the inductor in combination with the resistor exhibits an excellent noise-attenuation effect in the intermediate arrangement M, which is remarkably superior to the noise-attenuation effect attained by the inductor only (compare with FIG. 2). Further, when an inductor containing a resistance component of 3–5 KΩ shown in FIG. 4 is used, the inductor exhibits substantially the same noise-attenuation effect as that shown in FIG. 3 in the intermediate arrangement M.

Figure 5:
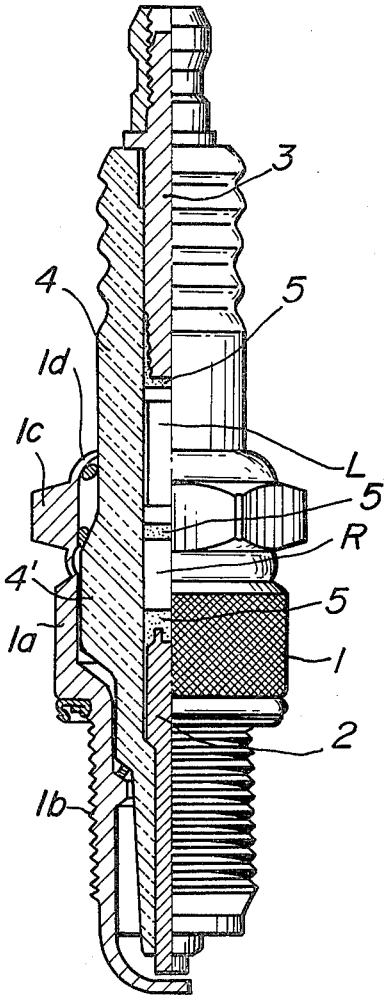
FIG. 5 is a front view of one embodiment of spark plugs according to the present invention, the left half of which is shown in cross-section.
Figure 6:
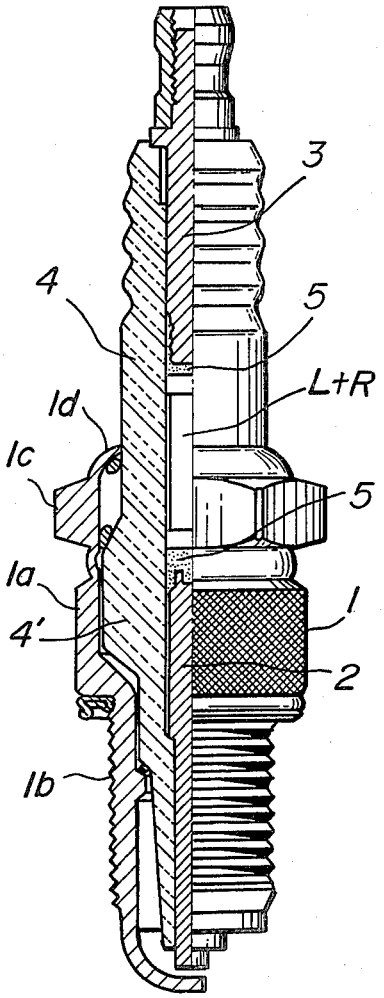
FIG. 6 is a front view of another embodiment of spark plugs according to the present invention, the left half of which is shown in cross-section.

FIGS. 5 and 6 show spark plugs used in the above described experiments. Referring to FIGS. 5 and 6, a ceramic insulator 4 having a bore, whose inner diameter is 4.7 mm exclusive of an inserting portion for a center electrode 2, is surrounded with a metal fitting 1 provided with a threaded portion 1*b* having a diameter of 14 mm. This metal fitting 1 is provided at the ignition portion of the ceramic insulator with a shell 1*a*, the above described threaded portion 1*b* and a nut-shaped portion 1*c* adapted for receiving a spanner. The ceramic insulator 4 is provided at its lower portion with the above described center electrode 2 incorporated in the bore and at its opposite head portion with a terminal electrode 3 secured in the bore under pressure. The shell 1*a* serves to embrace an enlarged central flange 4' of the ceramic insulator 4. The metal fitting 1 is provided at its top end with a caulking edge 1*d* for sealing refractory material powders filled in a space between the caulking edge 1*d* and the outer periphery of the tapered shoulder extending from the upper end of the enlarged central flange 4' of the ceramic insulator 4.

Accordingly, the metal fitting 1 surrounds the lower half of the ceramic insulator 4 from the enlarged central flange 4' to the ignition portion, and the caulking ege 1*d* can shield the bore of the ceramic insulator 4 from the external atmosphere in the portion not higher than the height of the caulking edge 1*d*.

A resistor R and an inductor L or an inductor containing a resistance component (R+L) was sealed in the interior of the bore of the ceramic insulator 4 between the center electrode 2 and the terminal electrode 3 by a glass seal 5.

The resistor R used in the spark plug shown in FIG. 5 was produced in the following manner. About 60 g of a mixture composed of 50 parts by weight (hereinafter parts mean parts by weight) of borosilicate glass, 50 parts of ceramic powders consisting mainly of alumina and containing zirconium, 5 parts of $TiO_2$ and 0.1–2 parts of carbon was sandwiched between about 15 g and 10 g of a conductive sealing material, which consisted of a mixture of glass powders having a softening point of about 800°–900° C. and alloy powders, such as Fe-B alloy powders and had a specific resistance of not higher than 100 Ω·mm after hardening, in the bore of the ceramic insulator, and heated under pressure to form the resistor R having a total length of about 10 mm and a resistance of 4 kΩ in the bore.

The inductor L used in the spark plug shown in FIG. 5 was produced by winding a nichrome wire having a diameter of 0.04 mm by 100 turns arround a ferrite core having an outer diameter of 4.0 mm and a length of 15 mm so that the resulting inductor L had a resistance of 800 Ω. The inductor L was inserted into the bore in series with the resistor R, and further 0.25 g of the above described conductive sealing material was arranged on the inductor L and then the terminal electrode 3 was inserted into the bore and the inductor L and the resistor R were sealed in the bore.

In this sealing step, in order to keep the heating temperature for the inductor L as low as possible at the insertion of the terminal electrode 3 into the bore, the terminal electrode 3 was inserted into the bore under pressure, while heating the ceramic insulator in a furnace under a condition that the resistor R and the sealing portion were locally heated at a temperature of 900°–950° C. and the inductor L was heated at a low temperature of not higher than 900° C.

As the result, the total resistance and inductance between the cetral electrode 2 and terminal electrode 3 inclusive of the glass seal 5 was 5 kΩ and 100 μH, respectively.

FIG. 5 shows a spark plug having the intermediate arrangement M of the inductor L shown in FIG. 3, wherein the inductor L is arranged extending to both sides of the sealed level formed by the caulking edge 1*d* of the metal fitting 1. Spark plugs having the internal arrangement I and external arrangement E of the inductor L shown in FIG. 3 can be obtained in substantially the same condition as described above, except that only the lengths of the central electrode 2 and terminal electrode 3 are changed.

In the spark plug shown in FIG. 6, a nichrome wire having a diameter of 0.035 mm was wound arround a ferrite core having a diameter and a length, which were somewhat larger and longer than those used in the core of the spark plug shown in FIG. 5, to produce a noise-attenuation element consisting of a cartridge type inductor containing a resistance component (L+R), which has a resistance of about 4 kΩ and an inductance of 150 μH, and the noise-attenuation element was sealed in the bore of a ceramic insulator 4 in the same manner as described in FIG. 5. FIG. 4 shows the noise-attenuation property of this attenuation element in the internal arrangement I, intermediate arrangement M and external arrangement E.

In the present invention, the noise-attenuation element may be composed only of an inductor. In this case, an inductor having an inductance of 20–500 μH and a length of 10–30 mm is preferably used. However, a noise-attenuation element composed of an inductor and a resistor arranged in series is more preferable. In this case, the length of the inductor and that of the resistor are preferred to be 10–30 mm and 5–10 mm respectively, and the inductance of the inductor is preferred to be 50–300 μH and the total resistance of the noise-attenuation element is preferred to be 3–10 kΩ. Further, a noise-attenuation element consisting of a cartridge type inductor containing a resistance component is preferably used as well. In this case, it is preferable that the noise-attenuation element has a length of 10–30 mm, an inductance of 20–300 μH and a total resistance of 2–7 kΩ.

In the above described examples, the resistor is produced from vitreous raw material powders having a specifically limited compounding recipe. However, vitreous raw material powders containing other substances, such as semiconductive material and the like, and further a solid cartridge type resistor, such as film resistor, can be used in the present invention.

In the present invention, it is necessary that the inductance component is hermetically sealed in the bore of the ceramic insulator at a proper position by the glass seal similarly to the sealing in the so-called conventional spark plug incorporating a resistor.

The inventors have made further investigations and found that the position of the above described winding type inductor in the bore of the ceramic insulator and the length of the inductor has a high influence upon the noise-preventing effect in the spark plug incorporating the inductor. That is, the inventors have found that noise can be prevented very effectively from low frequency range to high frequency range by limiting specifically the position and the length of the winding type inductor.

Figure 7:
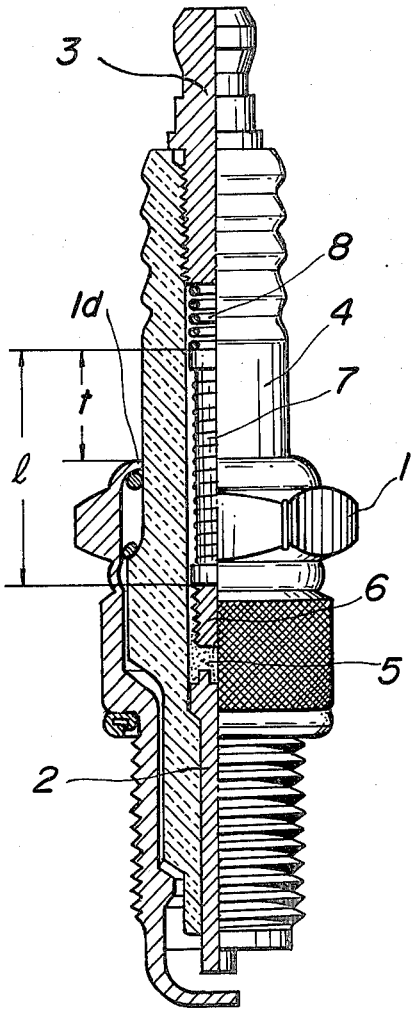
FIG. 7 is a front view of a further embodiment of spark plugs according to the present invention, the left half of which is shown in cross-section.

FIG. 7 shows a spark plug used in the experiments, which incorporates a winding type inductor. This spark plug was produced in the following manner. A center electrode 2 is previously inserted into a bore of a ceramic insulator 4, and a conductive glass 5 is charged into the bore. Then, a metal rod 6 is inserted into the bore and fused to the center electrode 2 through the conductive glass 5. A winding type inductor 7 and a spring 8 are inserted into the bore, and then a terminal electrode 3 is screwed into the bore so that the terminal electrode 3 contacts with the metal rod 6 through the inductor 7 and the spring 8. Then, the ceramic insulator 4 is surrounded with a metal fitting 1 in a conventional manner.

The inventors investigated the influence of the shape and position of the inductor in the bore upon the noise current, which flowed just after the spark discharge, by the use of the above described spark plug. The position of the inductor was adjusted by changing the length of the metal rod 6. With respect to the influence of the shape of the inductor upon the noise current, since the length has the highest influence, the length was varied. The inventors found by experiments that the thickness of the inductor had substantially no influence upon the noise current.

The noise current was measured in the following manner. A pressure in a high pressure chamber provided with the spark plug was adjusted so that the discharge would occur at a constant voltage of 15 KV, and a high voltage generated in an ignition coil was applied to the spark plug, and the discharge current, which flowed at the discharge, was supplied through an electric current probe into a noise electric field measuring device in the form of a noise current, and the value of the noise current was measured.

Figure 8:
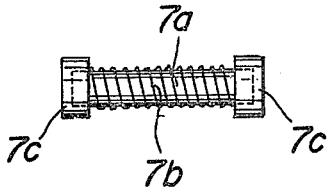
FIG. 8 is a front view of a winding type inductor used in the spark shown in FIG. 7.
Figure 9:
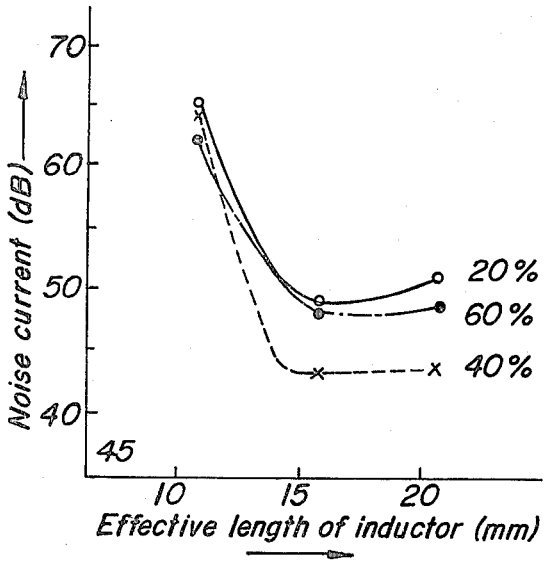
FIGS. 9–13 are graphs showing a relation between the effective length of the winding type inductor and the noise current measured at frequencies of 45, 90, 180, 400 and 700 MHz respectively, when the length of the inductor externally extended from the caulking edge of the metal fitting is 20%, 40% or 60% of the total length of the inductor, respectively.
Figure 10:
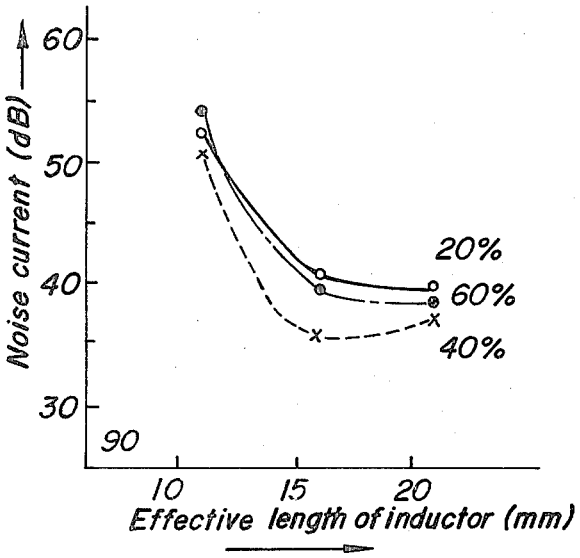
Figure 11:
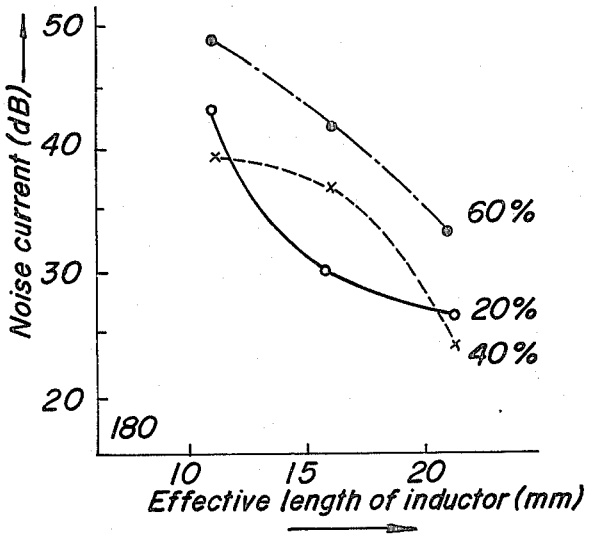
Figure 12:
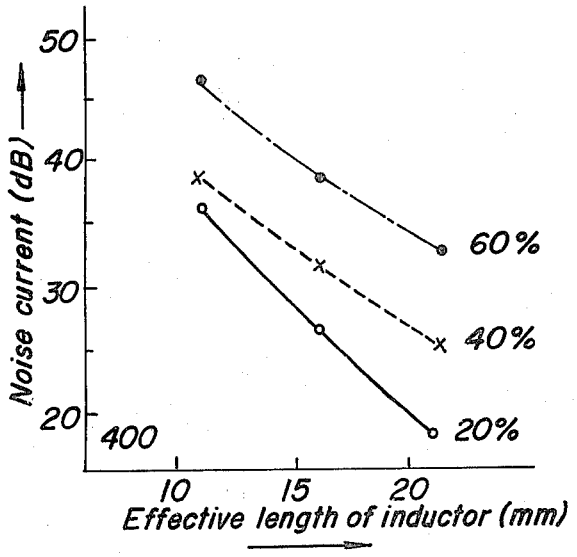
Figure 13:
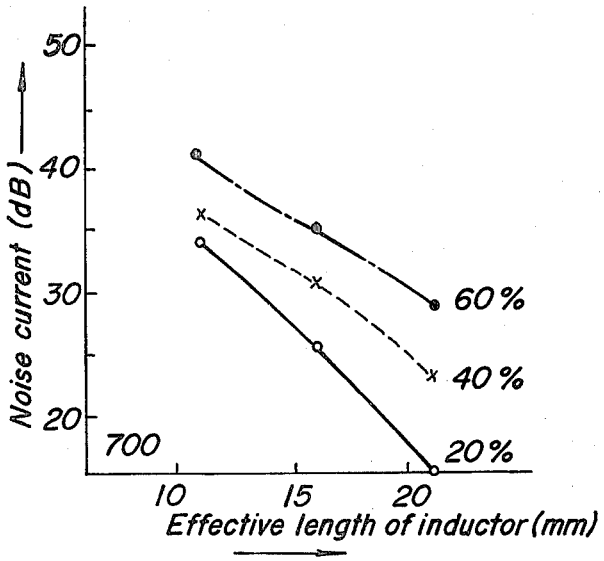

The inductor used in this experiment is, as shown in FIG. 8, composed of a ferrite core *7a*, a resistance wire *7b*, such as a nichrome wire, wound around the ferrite core *7a* in the coil form, and caps *7c* and *7c* arranged on both ends of the ferrite core *7a*. The inductor has a dimension and physical properties shown in the follow Table 1.

TABLE 1

| Length of inductor (mm) | Inductance (μH) | Resistance (kΩ) |
|---|---|---|
| 15 (effective length: 11) | 100 | 0.8 |
| 20 (effective length: 16) | 210 | 1.5 |
| 25 (effective length: 21) | 380 | 2.0 |

The effective length means the length of the inductor, which is obtained by subtracting the dimensions of the caps at the both ends from the total length (l).

The position of the inductor in the bore was varied by changing the externally extended length (t) of the inductor from the caulking edge 1*d* of the metal fitting 1 within the range of 0–80% of the total length (l) thereof as shown in FIG. 7, and the noise current was measured when the externally extended length of the inductor was 20%, 40% or 60% of the total length thereof, respectively.

FIGS. 9–13 show the results of the above described experiments at frequencies of 45, 90, 180, 400 and 700 MHz, respectively. These frequencies are those defined in CISPR Standard and SAE Standard.

In FIGS. 9–13, the noise current in the 20% externally extended length of the inductor is shown by a full line curve, that in the 40% externally extended length thereof is shown by a broken line curve, and that in the 60% externally extended length thereof is shown by a dot-dash line curve.

It can be seen from FIGS. 9–13 that, when the effective length (l) of the inductor and the position thereof in the bore of the ceramic insulator satisfy the following conditions, noise can be effectively prevented.

(1) A part of the inductor is extended externally from the caulking edge of the metal fitting at the low frequency range.
(2) The inductor is not extended externally from the caulking edge of the metal fitting at the high frequency range.
(3) An inductor having an effective length longer than a certain length gives a remarkably excellent noise-preventing effect.
(4) There is a proper length in the externally extended length of the inductor from the caulking edge of the metal fitting, since if the externally extended length of the inductor becomes longer or shorter than the proper length, it is impossible to prevent noise current.

These results will be explained by the use of concrete numerical values. When the effective length of the inductor is at least 15 mm, the noise current is very small in the low frequency range. Further, noise current decreases in proportion to the effective length of the inductor even in the high frequency range. While, the externally extended length of the inductor from the caulking edge of a metal fitting has different effects upon the noise current in the low frequency range and the noise current in the high frequency range. However, when the externally extended length of the inductor is 30–60% of the total length thereof, noise can be effectively prevented. Particularly, when the externally extended length of the inductor is about 40% of the total length thereof, noise can be remarkably effectively prevented in the low frequency range.

As described above, when an inductor having an effective length of at least 15 mm is inserted into a bore of a ceramic insulator so that 30–60% of the total length of the inductor is extended externally from the caulking edge of the metal fitting, a spark plug incorporating a winding type inductor and having a very low noise level from the low frequency range to the high frequency range can be obtained.

As described above, according to the spark plug of the present invention, which incorporates a winding type inductor, noise can be effectively attenuated without the influence of frequency in the wide frequency range of 20–1,000 MHz, wherein a legal restriction for electric wave disturbance is actually required. Therefore, the use of the spark plug according to the present invention is very effective for preventing noise, which is generated in an ignition circuit of internal combustion engine used in various fields, without causing voltage drop and leakage of electric current under a high-moisture environment, which occurs always in a conventional shield type plug cap incorporating a winding type inductor.

What is claimed is:

1. In a spark plug having a low noise level, comprising a ceramic insulator having a bore, a metal fitting surrounding the insulator, a center electrode, a terminal electrode and a noise-attenuation element arranged in the bore of the insulator and sealed to the center and terminal electrodes through glass, an improvement comprising said noise-attenuation element consisting of an inductance component alone or a combination of an inductance component with a resistance component, and said inductance component being arranged extending to both sides of a sealed level for the noise-attenuation element formed by an end of the metal fitting which is connected to the insulator.

2. A spark plug having a low noise level according to claim 1, wherein the noise-attenuation element consists of an inductor and a resistor, said inductor being arranged extending to both sides of the sealed level for the noise-attenuation element by the metal fitting, and said resistor being arranged between the inductor and center electrode.

3. A spark plug having a low noise level according to claim 1, wherein said noise-attenuation element is a winding type inductor containing a resistance component.

4. A spark plug having a low noise level according to claim 3, wherein said winding type inductor has an effective length of at least 15 mm and is arranged in the bore of the ceramic insulator so that 30–60% of the total length of the inductor extends externally from the sealed level for the inductor by the metal fitting.

* * * * *